United States Patent [19]

Wood, Jr.

[11] 4,406,630

[45] Sep. 27, 1983

[54] FISHING BOAT FOR USE WITH ELECTRICALLY POWERED FISHING MOTORS

[75] Inventor: Garfield A. Wood, Jr., Monroe, La.

[73] Assignee: Woodstream Corporation, Lititz, Pa.

[21] Appl. No.: 254,512

[22] Filed: Apr. 15, 1981

[51] Int. Cl.[3] ..... B63H 21/26

[52] U.S. Cl. ..... 440/6; 114/144 R; 114/57

[58] Field of Search ..... 440/6, 7, 54, 75; 114/39, 56, 57, 242, 144 R; 318/412

[56] References Cited

U.S. PATENT DOCUMENTS

| | | | |
|---|---|---|---|
| 5,162 | 6/1847 | Shermer | 114/144 R |
| 867,654 | 10/1907 | Golden | 114/57 |
| 1,774,956 | 9/1930 | Wilson | 440/54 |
| 2,213,611 | 9/1940 | Ronning | 440/54 |
| 2,361,409 | 10/1944 | Munro | 114/56 |
| 2,887,978 | 5/1959 | Tritt | 114/56 |
| 3,013,519 | 12/1961 | Wiggermann | 440/75 |
| 3,176,645 | 4/1965 | Shatto, Jr. | 114/144 R |
| 3,238,911 | 3/1966 | Pazulski | 114/39 |
| 3,264,540 | 8/1966 | Dannettell | 318/412 |
| 3,587,512 | 6/1971 | Patterson | 440/54 |
| 3,685,481 | 8/1972 | Mansell | 440/54 |
| 3,711,755 | 1/1973 | Meyer, Jr. | 440/6 |
| 3,750,607 | 8/1973 | Seymour et al. | 114/242 |
| 3,930,455 | 1/1976 | Bremer | 114/56 |
| 3,983,834 | 10/1976 | Hirmann | 114/144 R |
| 4,125,081 | 11/1978 | Tindal | 440/7 |

*Primary Examiner*—Trygve M. Blix
*Assistant Examiner*—Jesus D. Sotelo
*Attorney, Agent, or Firm*—Woodcock, Washburn, Kurtz, Mackiewicz & Norris

[57] ABSTRACT

A fishing boat for use with a pair of electrically powered fishing motors wherein the boat hull has double end bottom running surfaces and a bottom pod extending below the running surfaces between the bow and the stern of the hull along the center line of the hull, the pod being shaped to receive an electrical power source for the motors and having a longitudinal dimension greater than the transverse dimension of the pod and each of the dimensions being less than the corresponding dimensions of the boat hull. The boat hull has a first well molded into the bottom thereof between the bow and the adjacent end of the pod along the center line of the hull and the boat hull has a second well molded into the bottom thereof between the stern and the other end of the pod along the center line of the hull. The boat also includes a removably mounted electrically powered fishing motor in each of the first and second wells in the bottom of the boat hull. Electrical connections are provided for electrically connecting the electrically powered fishing motors for joint and selective operation thereof as well as structure for mechanically connecting the electrically powered fishing motors for controlling the direction of movement of the fishing boat.

7 Claims, 14 Drawing Figures

FISHING BOAT FOR USE WITH ELECTRICALLY POWERED FISHING MOTORS

BACKGROUND OF THE INVENTION

This invention relates to improvements in fishing boats used with electrically powered fishing motors. Heretofore electrically powered fishing motors have normally been mounted either on the stern or the bow of the boat and serve as supplemental or secondary propulsion means in conjunction with a normal outboard motor. The outboard motor is used for propelling the boat from one fishing location to another and the electrically powered fishing motors are used for trolling. The prior art arrangements employing electrically powered fishing motors as secondary propulsion means have left something to be desired in operation and the problems are outlined in such prior art as U.S. Pat. No. 3,685,481—Mansell and U.S. Pat. No. 3,587,512—Patterson. The present invention overcomes these difficulties of the prior art by eliminating the need for the normal outboard motor which in turn eliminates the need for gasoline as a source of fuel to power the outboard motor. With the increasing cost of gasoline and the short supply thereof it has become increasingly important to power a fishing boat by some source other than gasoline. The problems of the prior art are overcome by the present invention utilizing a unique boat hull powered by a pair of electrically powered fishing motors.

SUMMARY OF THE INVENTION

It is an object of the present invention to provide a fishing boat, the motor power for which is derived solely from a pair of electrically powered fishing motors.

In accordance with the present invention there is provided a fishing boat for use with a pair of electrically powered fishing motors comprising a boat hull having double end bottom running surfaces and a bottom pod extending below the running surfaces between the bow and the stern of the hull along the center line of the hull. The pod is shaped to receive an electrical power source for the motors and has a longitudinal dimension greater than the transverse dimension of the pod and each of the dimensions is less than the corresponding dimensions of the boat hull. The boat hull has a first well molded into the bottom thereof between the bow and the adjcent end of the pod along the center line of the hull, the boat hull also having a second well molded into the bottom thereof between the stern and the other end of the pod along the center line of the hull, and means for removably mounting an electrically powered fishing motor in each of the first and second wells in the bottom of the boat hull.

The fishing boat also includes means for electrically connecting the electrically powered fishing motors for joint and selective operation thereof and means for mechanically connecting the electrically powered fishing motors for controlling the direction of movement of the fishing boat. The speed of movement of the fishing boat is controlled by changing the voltage applied to the electrically powered fishing motors from the electrical power source. The means for changing the voltage is accomplished by selectively connecting the electrically powered fishing motors across selected voltage portions of the electrical power source.

The electrically powered fishing motors are mechanically connected by an endless cable extending around the periphery of the hull and mechanically connected to each of the electrically powered fishing motors so that by turning one fishing motor in one direction with respect to the center line of the hull, the other fishing motor will be caused to turn simultaneously toward the opposite side of the center line of the hull. Each of the electrically powered fishing motors includes a propeller mounted at the lower end of a vertically extending pivotal shaft, each shaft having at the upper end a lever secured thereto for rotation with the shaft, and means on each lever for connection to the endless cable. The bottom pod provides stability for the fishing boat and a storage area for the electric batteries. The pod extends below the bottom running surfaces of the boat hull a distance greater than the electrically powered fishing motors and thus provides protection for the fishing motors in shallow water. Additional protection may be provided for the electric motors by means of a skid or guard connected from the bottom ends of the pod to the adjacent bottom ends of the boat hull.

DETAILED DESCRIPTION OF THE PREFERRED EMBODIMENT

Figure 1:
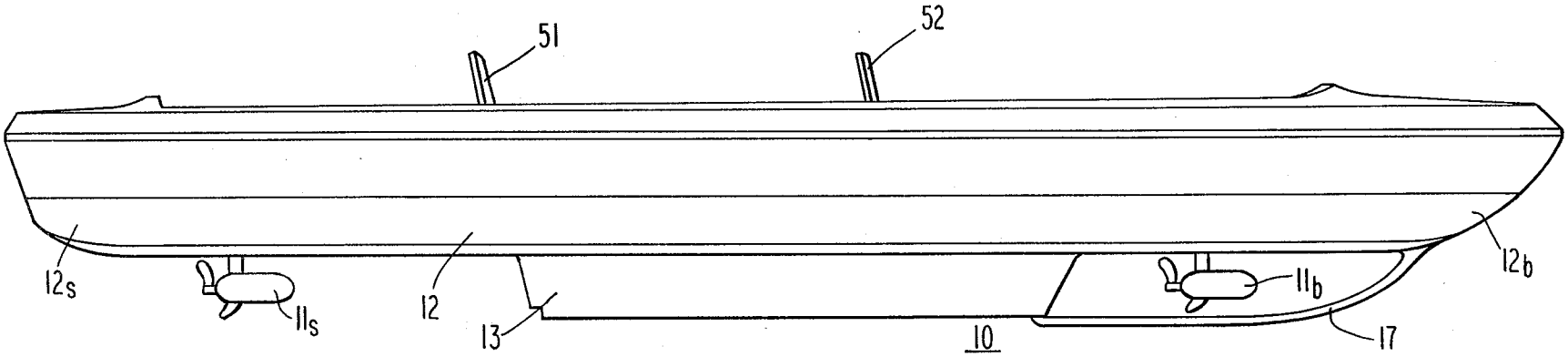
FIG. 1 is a side elevational view of a fishing boat embodying the present invention.

Referring to FIGS. 1–4 there is shown a fishing boat 10 adapted for use with a pair of electrically powered fishing motors 11. For convenience the bow motor is identified as **11*b* and the stern motor as 11*s*. The boat hull 12 is of unique design having double end bottom running surfaces with conventional shear together with a bottom pod 13 which gives stability as well as providing out of the way battery storage for the electric storage batteries 14 and 15 which power the fishing motors as well as the auxiliary battery 16 for operating accessories on the boat. Both ends of the boat hull are tapered to a point at 12*b* and 12*s* for ease of operation of the boat in either direction. The bottom pod 13 extends below the running surfaces of the hull a distance greater than the fishing motors 11*b*, 11*s* and is located between the bow and the stern of the hull along the center line thereof. The pod 13 is shaped to receive the electrical power source for the motors 11***b*, 11*s* and has a longitudinal dimension greater than the transverse dimension of the pod with each of these dimensions being less than the corresponding dimension of the boat hull. The pod 13 and the guard 17 provide protection for the fishing motors in shallow water.

Figure 3:
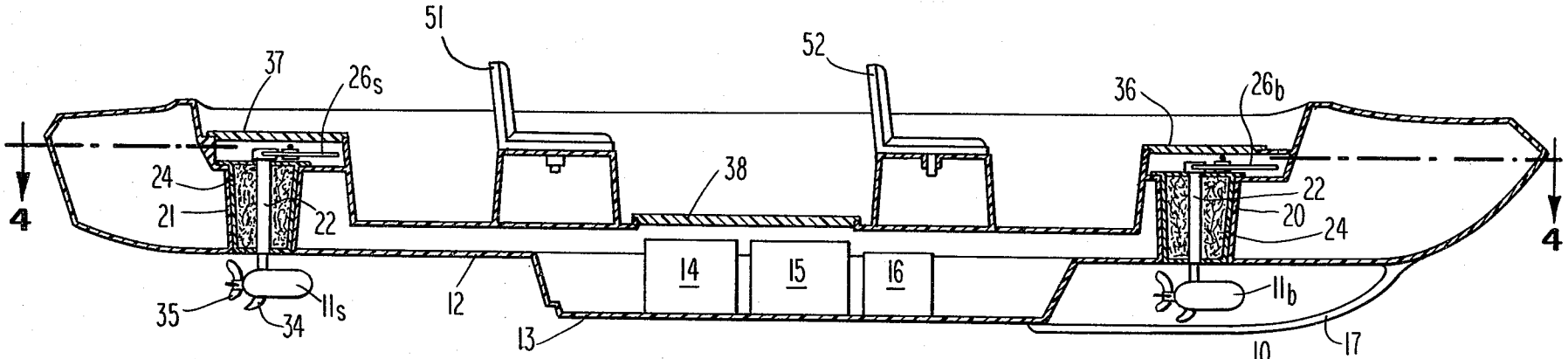
FIG. 3 is a vertical cross sectional view of the fishing boat taken along the lines 3—3 in FIG. 2.
Figure 7:
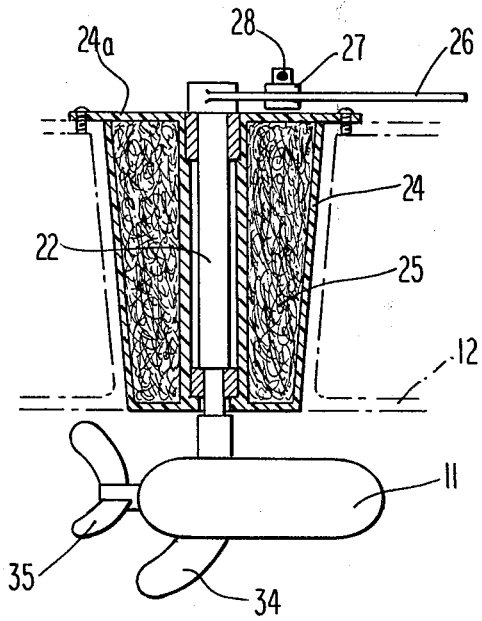
FIG. 7 is a fractional sectional view of one of the electrically powered fishing motors shown in FIG. 3.

The boat hull 12 preferably is molded from fiberglass or other suitable material and as shown in FIG. 3 has a first or bow well 20 molded into the bottom thereof between the bow and the adjacent end of the pod 13 along the center line of the hull. A second or stern well 21 is molded into the bottom of the hull between the stern and the other end of the pod 13 along the center line of the hull. Both of the wells 20, 21 of the identical construction and have a rectangular configuration with their width being greater than their length to accommodate the insertion and removal of the bow and stern electric motors 11*b*, 11*s* as now to be described. Each of the wels 20, 21 is adapted to have removably mounted therein one of the electric fishing motors 11*b*, 11*s*. Each of the wells 20, 21 has a substantial depth so that the top of the well is above the water line of the hull 12 and the bottom of the well is below the water line of the hull whereby the electrical fishing motors 11*b*, 11*s* may be removed from the wells 20, 21 while the boat 10 is in the water. As may be seen in FIGS. 3 and 7 the electrical fishing motors 11*b*, 11*s* are carried at the lower end of a vertical shaft 22 which is journaled for pivotal movement within a casing 24 shaped to fit and be received in one of the wells 20 and 21. The bottom of the casing 24 is flush with the exterior bottom surface of the boat hull 12 to provide ease of movement of the hull through the water. The top of the casing 24 is provided with a cover 24*a* adapted to be secured to the hull by screws, FIG. 7. The interior of the casing 24 is filled with a suitable insulation material 25. At the upper end of the shaft 22 there is provided a lever 26 having a slot therein which is adapted to receive a slidable member 27 which in turn is connected to a cable 28 for rotating the electric motors 11*b*, about their respective shafts 22.

Figure 4:
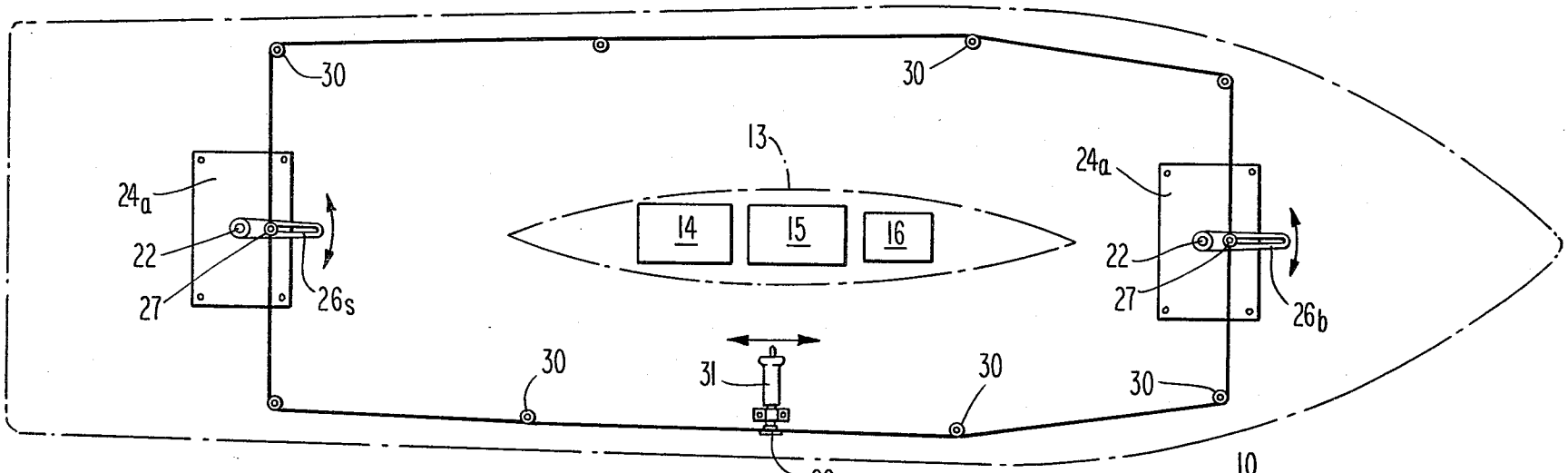
FIG. 4 is a horizontal cross sectional view of the fishing boat taken along the lines 4—4 in FIG. 3 showing the mechanical connecting means for the electrically powered fishing motors.
Figure 5:
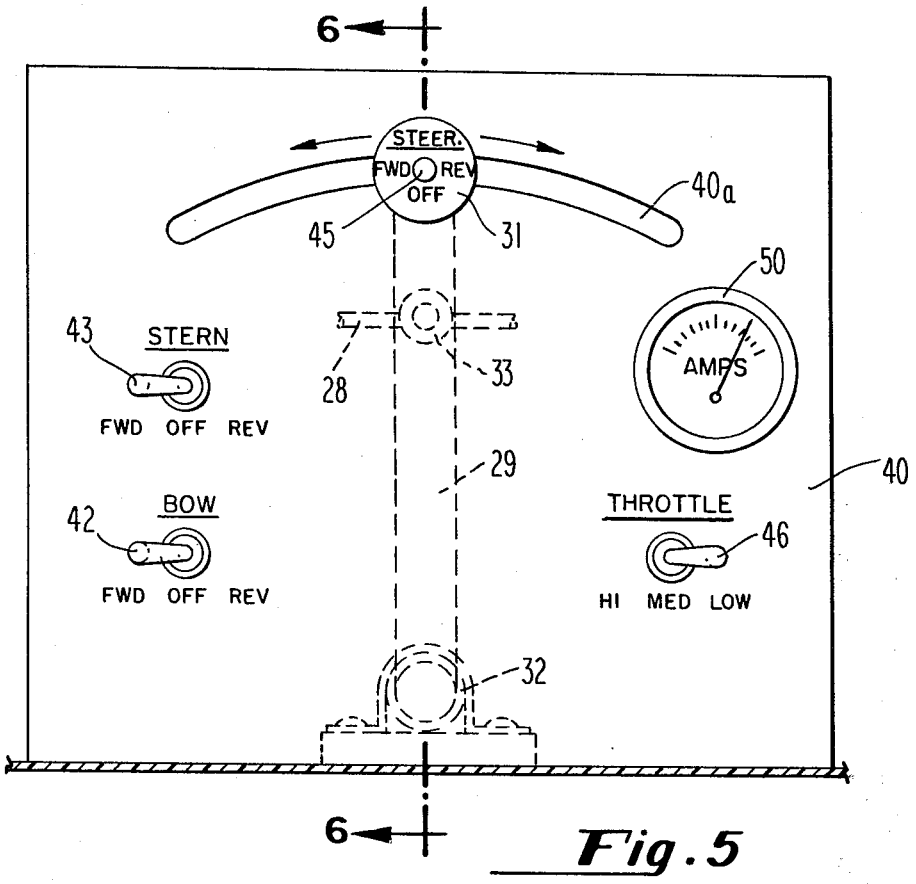
FIG. 5 is an elevational view of the control panel of the fishing boat taken along the lines 5—5 in FIG. 2.
Figure 6:
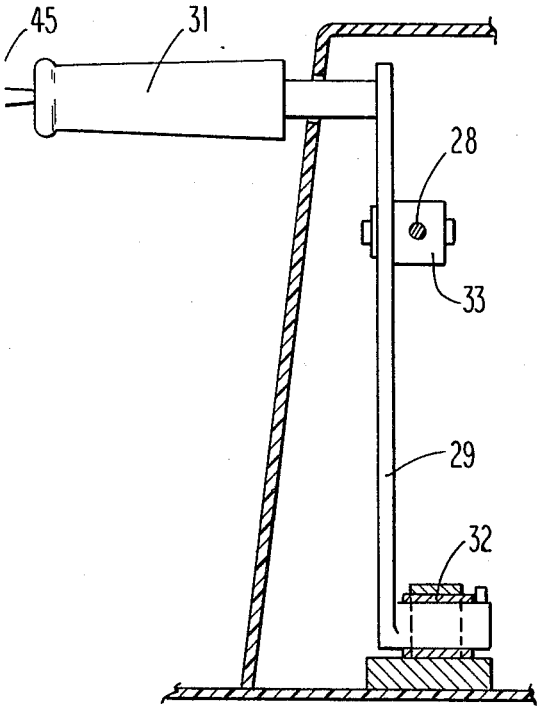
FIG. 6 is a cross sectional view taken along the lines 6—6 in FIG. 5 showing the steering control.

As may be seen in FIG. 4 the cable 28 is connected to a steering arm 29, FIG. 6, and the cable 28 extends around a series of pulleys 30 which are supported around the periphery of the cockpit of the fishing boat, FIG. 4. The steering arm 29 is provided with a handle 31 at its upper end and at its lower end it is journaled at 32 on the boat hull. Intermediate the ends of the steering arm 29 is a connecting member 33 which is secured to the cable 28, FIG. 6. As may be seen in FIGS. 4 and 5 the steering arm 29 and its associated handle 31 may be moved to the right or to the left as indicated by the arrows and this movement in turn imparts a corresponding movement through the cable 28 to the slotted levers 26 which in turn impart rotational movement to the shafts 22 and the electric fishing motors 11. As may be seen in FIG. 4 when the steering handle 31 is moved to the right the lever 26*b* at the bow of the boat and the associated fishing motor 11*b* will be rotated in a counter clockwise direction and the lever 26*a* at the stern end of the boat and the associated fishing motor 11*s* will be rotated in a clockwise direction. When the steering handle 31 is moved to the left in FIG. 4 an opposite rotation of the levers 26*b*, 26*s* and fishing motors 11*b*, 11*s* takes place.

The fishing motors 11*b*, 11*s* are of conventional type and normally include an electric motor within a housing which in turn has a fin 34 extending from the bottom thereof. The electric motor has a shaft on which is mounted a propeller 35 which is adapted to impart the movement to the fishing boat. While the fishing motors in the drawing have been illustrated as having the electric motor disposed beneath the water line, it is to be understood that other types of fishing motors may be used where the electric motor is disposed above the water line and only the propeller and fin are disposed below the water line as for example in U.S. Pat. No. 3,587,512.

As shown in FIG. 3 the fishing motors 11*b*, 11*s* have a length greater than the corresponding dimension of the casings 24 and the wells 20 and 21. In order to remove the fishing motors from their position in the boat hull the levers 26*b*, 26*s* are rotated through 90 degrees from the position illustrated in FIGS. 3 and 4. It will be noted that the casing 24 have a transverse dimension greater than the length of the fishing motors 11*b* and 11*s* and thus with the latter in the rotated position the complete unit including the casing 24, the fishing motors and the vertical shafts 22 therefor can be removed from the wells in the boat hull. This ease of removal of the fishing motor units is desirable in the event the propellers on the fishing motors should become fouled with grass or other debris during operation. The access to the wells and the fishing motor units is by way of the removable hatches 36 and 37 at the foward end and aft end of the boat hull. The electric storage batteries 14–16 are accessible through the removable hatch 38 in the floor of the boat hull.

Figure 2:
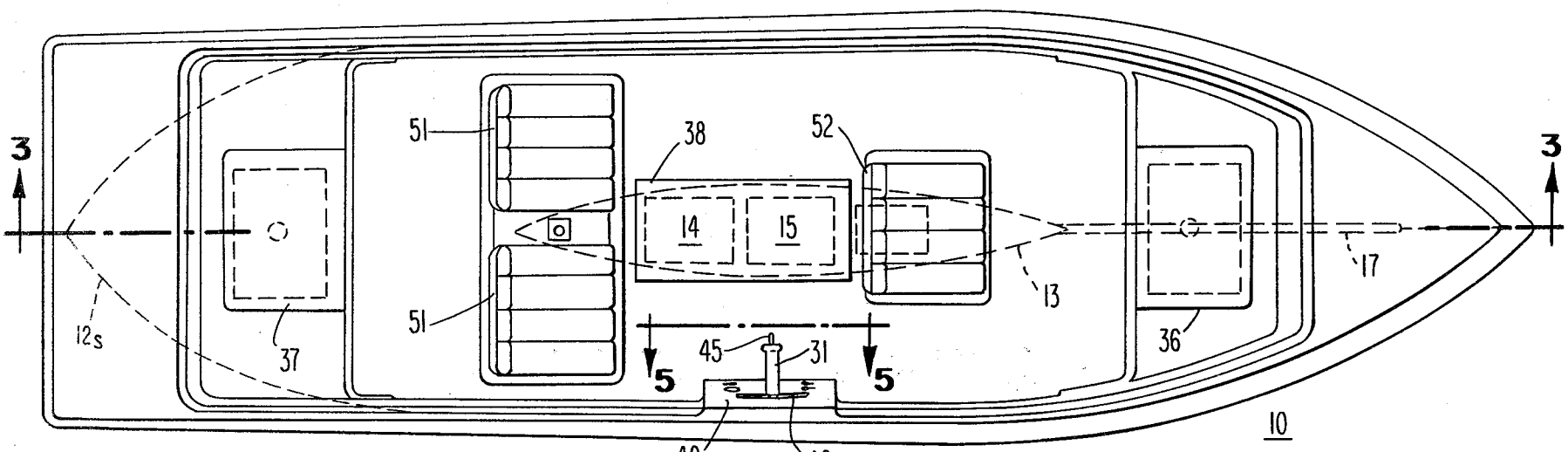
FIG. 2 is a top plan view of the fishing boat shown in FIG. 1.
Figure 8:
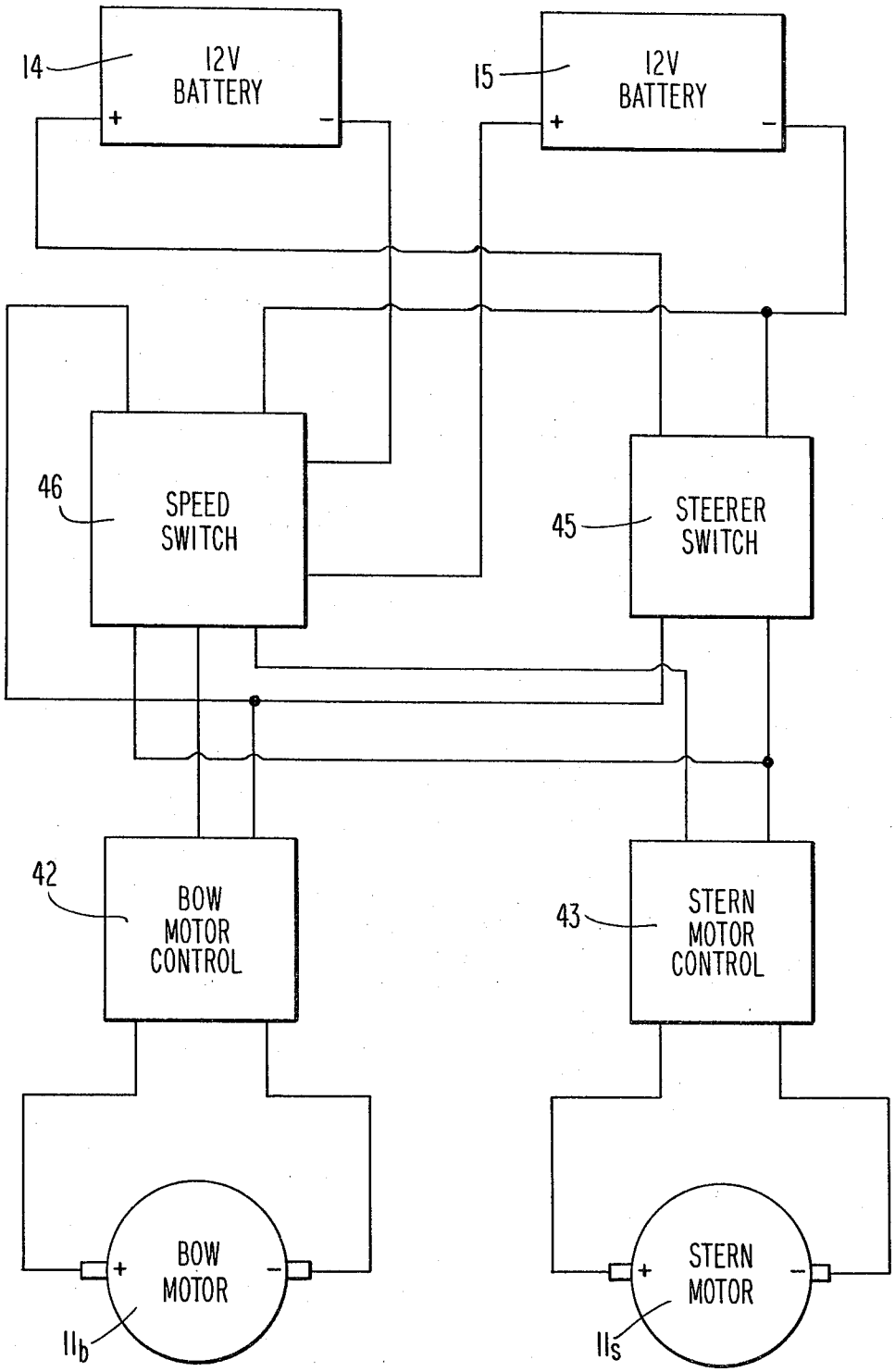
FIG. 8 is an electrical circuit diagram showing the electrically powered motors, the battery source therefor and the associated switching for controllng the motors of the fishing boat from the control panel shown in FIG. 5.

The boat 10 is adapted to be operated from a control panel 40 shown in FIGS. 2 and 5. As previously pointed out, the mechanical movement of the fishing motors 11*b*, 11*s* is accomplished by rotation of the handle 31 in the slot 40*a* which causes the steering arm 29 to pivot about its journaled end 32. Movement of the arm 29 causes the cable 28 attached to it by connecting member 33 to rotate the levers 26*b*, 26*s* on the shafts 22 thereby rotating the fishing motors 11*b* and 11*s* in the desired direction. The electrical control for the fishing motors 11*b*, 11*s* is also associated with the control panel 40. The bow switch 42 shown in FIG. 5 and FIG. 8 directly controls the bow fishing motor 11*b* shown in FIGS. 1 and 3. The stern switch 43 shown in FIGS. 5 and 8 directly controls the stern fishing motor 11*s* shown in FIGS. 1 and 3. As shown in FIG. 5 and hereinafter described the switches 42 and 43 are effective to cause the fishing motors 11*b*, 11*s* to operate these motors in either a forward or reverse direction or to turn them off. The control panel 40 is also provided with a throttle or speed switch 46 which is adapted to operate the fishing motors at predetermined speeds as hereinafter to be described. The switches 42, 43 and 45 are conventional toggle switches of the two pole three position type with the off position in the center as illustrated in FIG. 5. The throttle or speed switch 46 shown in FIGS. 5 and 8 is a four pole three position switc with the power on in all three positions and no off position. A switch of this type is manufactured by Micro Switch division of Honeywell, catalog #4TL5-12.

Figure 9A:
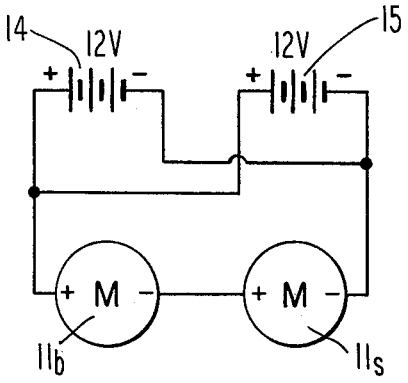
FIGS. 9A to 9F are electrical schematic diagrams showing the various circuit connections for operating the electrically powered fishing motors in the various selected modes.
Figure 9D:
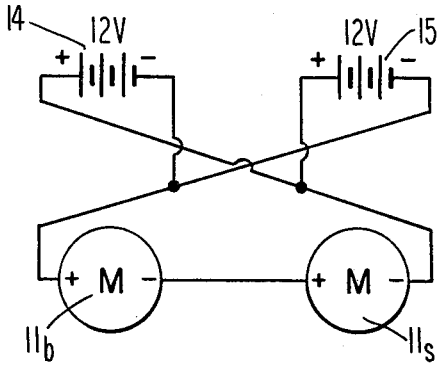

It has been found that a pair of 12 volt heavy duty electric storage batteries 14, 15 will provide adequate power for the fishing boat 10. The speed of the fishing boat is controlled by varying the voltage applied to the electric fishing motors 11*b*, 11*s*. The control circuit for the electric boat 10 has been designed to provide five speeds. The first or low speed is obtained by operating the motors on 6 volts as schematically illustrated in FIG. 9A. As shown in FIG. 5 the bow switch 42 and stern switch 43 are both in the forward position "FWD" and the throttle switch 46 is in the "LOW" position. When the steerer switch 45 is moved from "OFF" to the forward position "FWD" the fishing motors 11*b* and 11*s* will be electrically connected in series across each of the 12 volt batteries as illustrated in FIG. 9A. By moving the steerer switch 45 to the reverse position "REV" the fishing motors 11*b*, 11*s* will be electrically connected as illustrated in FIG. 9D and will provide operation of the boat 10 in reverse direction on 6 volts. By moving the throttle switch 46 to the medium position "MED" shown in FIG. 5 and with the steerer switch 5 in the forward position the fishing motors 11*b*, 11*s* will be electrically connected in the manner schematically illustrated in FIG. 9B where each motor has 12 volts applied to it. FIG. 9E shows a similar operation of the motors to that of FIG. 9B but with the steerer switch 45 in the reverse position for reverse operation of the motors 11*b*, 11*s*. When the throttle switch 46 is moved to the high position "HI" as shown in FIG. 5 and the steerer switch 45 is in the forward position the fishing motors 11*b*, 11*s* will be electrically connected in the manner schematically illustrated in FIG. 9C where each of the motors has 24 volts applied to it. FIG. 9F illustrates a similar operation to that of FIG. 9C but with the steerer switch 45 in the reverse position for operating the electric motors 11*b*, 11*s* in reverse direction.

As pointed out above, the control circuit for the electric boat 10 has been designed to provide five speeds in forward or reverse. The foregoing description describes the operation of the boat at low, medium and high speeds with both of the fishing motors 11*b* and 11*s* operating at the same time. When the boat is operating at low speed both of the motors 11*b* and 11*s* are connected in series as shown in FIGS. 9A and 9D. Thus when throttle switch 46 is in the "LOW" position, both the bow switch 42 and the stern switch 43 must be in the on position either forward or reverse. In FIGS. 9B and 9C and FIGS. 9E and 9F it will be seen that the fishing motors 11*b* and 11*s* are connected in parallel with respect to the batteries 14, 15. With this circuit arrangement either of the motors 11*b* or 11*s* may be operated independently of the other to provide different speeds.

Figure 9B:
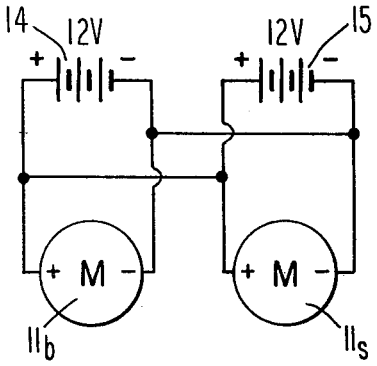
Figure 9E:
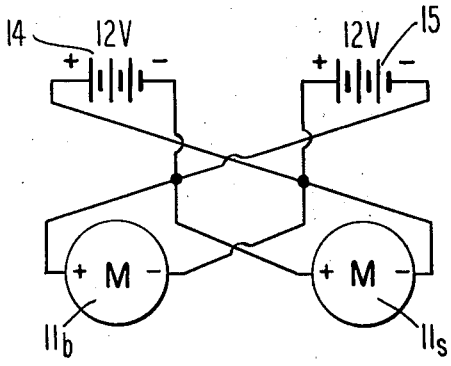
Figure 9C:
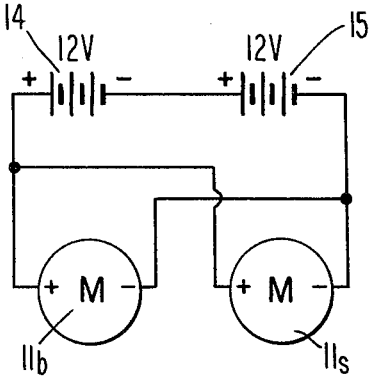
Figure 9F:
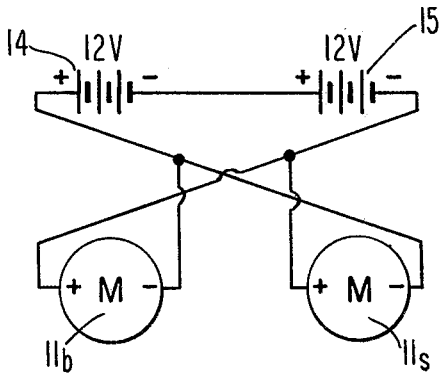

For example with the circuit arrangement shown in FIG. 9B when the throttle switch 46 is in the "MED" position, FIG. 5, either the stern switch 43 or the bow switch 42 may be moved to off position thus disconnecting its corresponding motor from the circuit. With this arrangement, there will be only one motor operating at 12 volts and thus provide an intermediate speed between the low speed setting of the throttle switch 46 and its medium speed setting. A similar control is provided with the circuit arrangement of FIG. 9E except the movement of the boat 10 will be in reverse direction. In FIG. 9C both of the motors 11*b* and 11*s* are connected in parallel across both of the batteries 14 and 15. This is the circuit arrangement when the throttle switch 46 is in the high (HI) position thus providing two motors operating at 24 volts. By moving either the stern switch 43 or the bow switch 42 to the off position this will provide for operation of a single motor at 24 volts. This will provide an operation of the boat 10 at a speed which is intermediate the speed provided with the throttle 46 in the medium position and high position with both motors operating. It will be apparent that a similar operation in the reverse direction can be obtained with the circuit illustrated in FIG. 9F. Thus it will be seen that the circuit control shown in FIGS. 5 and 8 provides for a five speed operation of the boat 10 in either the forward or reverse directions.

Performance tests have been conducted to determine the weight distribution and approximate speed and range at different voltage settings. Speeds were recorded with a Sail-O-Meter with the recordable range from 0 to 15 knots. The electric boat tested had a gross weight less passengers of 365 lbs. The two fishing motors were basically the same frame, however, the bow motor was less efficient than the stern motor as will hereinafter be seen from the tables. In the tables, the last three columns include adjustments to show estimated performance when two motors of equal efficiency are used. It will also be noted that in each of the three tables the current drain recorded at the various speeds ranged from 2 to 30 amperes This was recorded by an ammeter such as the ammeter 50 shown in FIG. 5.

The following data in Table I was obtained by operating the electric boat with one person in the stern position as illustrated by the aft or stern seats 51 in FIGS. 1–3.

TABLE I

| | | | | Adj. for Equal Mtrs. | | |
|---|---|---|---|---|---|---|
| | Amps. | Knots | MPH | MPH | Hours | Range |
| 2 motors 6 volts | 2 | 1.4 | 1.6 | 1.7 | 50 | 85 mi. |
| 1 motor 12 volts (bow) | 4 | 2.2 | 2.5 | | | |
| | | | | 3.5 | 25 | 87 mi. |
| 1 motor 12 volts (stern) | 4 | 3.0 | 3.5 | | | |
| 2 motors 12 volts | 7 | 3.4 | 3.9 | 4.5 | 14 | 63 mi. |
| 1 motor 24 volts (bow) | 17.5 | 3.8 | 4.4 | | | |
| | | | | 5.3 | 5.5 | 30 mi. |
| 1 motor 24 volts (stern) | 18 | 4.6 | 5.3 | | | |
| 2 motors 24 volts | 30 | 6.2 | 7.1 | 7.8 | 3 | 23 mi. |

From Table I it will be seen that the data shows the operation of the fishing boat with two motors at 6 volts and one or two motors at 12 or 24 volts. It is also apparent from the data that the bow motor was far less efficient than the stern motor. With adjustment of the data for equal motors, the speed ranged from 1.7 miles per hour to 7.8 miles per hour. The batteries provided operation of the motors at low speed for approximately 50 hours for a range of 85 miles while the operation of the boat at high speed provided operation for 3 hours for a range of approximately 23 miles.

The following data in Table II was compiled by the operation of the electric boat with two persons in the aft or stern position of seats 51, FIGS. 1–3.

TABLE II

| | Amps | Knots | MPH | Adj. for Equal Mtrs. MPH | Hours | Range |
|---|---|---|---|---|---|---|
| 2 motors 6 volts | 2 | 1.4 | 1.6 | 1.7 | 50 | 85 mi. |
| 1 motor 12 volts (bow) | 4 | 2.0 | 2.3 | | | |
| | | | | 3.2 | 25 | 80 mi. |
| 1 motor 12 volts (stern) | 4 | 2.8 | 3.2 | | | |
| 2 motors 12 volts | 7 | 3.2 | 3.7 | 4.3 | 14 | 60 mi. |
| 1 motor 24 volts (bow) | 17.5 | 3.6 | 4.1 | | | |
| | | | | 4.9 | 5.5 | 27 mi. |
| 1 motor 24 volts (stern) | 18 | 4.3 | 4.9 | | | |
| 2 motors 24 volts | 30 | 5.8 | 6.7 | 7.3 | 3 | 22 mi. |

From the data set forth above in Table II it will be seen that the speed and the range of the boat did not decrease appreciably with the addition of the second person in the aft position.

The data in the following Table III was obtained with two persons in the boat, one in the stern position as indicated by seat 51 and one in the bow or forward position as indicated by seat 52 in FIGS. 1–3.

TABLE III

| | Amps | Knots | MPH | Adj. for Equal Mtrs. MPH | Hours | Range |
|---|---|---|---|---|---|---|
| 2 motors 6 volts | 2 | 1.2 | 1.4 | 1.5 | 50 | 75 mi. |
| 1 motor 12 volts (bow) | 4 | 1.8 | 2.0 | | | |
| | | | | 3.0 | 25 | 75 mi. |
| 1 motor 12 volts (stern) | 4 | 2.6 | 3.0 | | | |
| 2 motors 12 volts | 7 | 3.2 | 3.7 | 4.3 | 14 | 60 mi. |
| 1 motor 24 volts (bow) | 18 | 3.3 | 3.8 | | | |
| | | | | 4.6 | 5.5 | 25 mi. |
| 1 motor 24 volts (stern) | 18 | 4.0 | 4.6 | | | |
| 2 motors 24 volts | 30 | 5.4 | 6.2 | 6.8 | 3 | 20 mi. |

From the data in Table III it will be seen that the distribution of weight in the boat does affect the speed. Comparing the data of Table II with that of Table III it will be seen that with one of the persons in the forward or bow seat 52 the speeds are decreased over those where both persons are in the aft or stern position 51.

What is claimed is:

1. A fishing boat for use with a pair of electrically powered fishing motors comprising:

a boat hull having double end bottom running surfaces and a bottom pod extending below said running surfaces between the bow and the stern of the hull along the center line of the hull, said pod being shaped to receive an electrical power source for the motors and having a longitudinal dimension greater than the transverse dimension of said pod and each of said dimensions being less than the corresponding dimensions of said boat hull, said boat hull having a first well molded into the bottom thereof between the bow and the adjacent end of said pod along the center line of the hull, said boat hull having a second well molded into the bottom thereof between the stern and the other end of said pod along the center line of the hull, means for removably mounting an electrically powered fishing motor in each of said first and second wells in the bottom of said boat hull, an electrically powered fishing motor mounted in each of said wells in said boat hull, means for electrically connecting said electrically powered fishing motors for joint and selective operation thereof, and means for mechanically connecting said electrically powered fishing motors for controlling the direction of movement of the fishing boat, said means for mechanically connecting said electrically powered fishing motors comprises an endless cable extending around the periphery of the hull and mechanically connected to each of the electrically powered fishing motors so that by turning one fishing motor in one direction with respect to the center line of the hull, the other fishing motor will be caused to turn simultaneously toward the opposite side of the center line of the hull.

2. A fishing boat according to claim 1 wherein each of said wells molded into the bottom of said boat hull has a substantial depth so that the top of the well is above the water line of the hull and the bottom of the well is below the water line of the hull whereby the electrically powered fishing motors may be removed from the wells while the boat is in the water.

3. A fishing boat according to claim 1 including means for changing the voltage applied to said electrically powered fishing motors from the electrical power source for controlling the speed of movement of the fishing boat.

4. A fishing boat according to claim 3 wherein the means for changing the voltage applied to said electrically powered fishing motors comprises means for selectively connecting said electrically powered fishing motors across selected voltage portions of the electrical power source.

5. A fishing boat according to claim 1 wherein each of said electrically powered fishing motors is mounted at the lower end of a vertically extending pivotal shaft, each shaft having at the upper end a lever secured thereto for rotation with the shaft, and means on each lever for connection to the endless cable.

6. A fishing boat according to claim 1 wherein said electrically powered fishing motors includes a propeller mounted at the lower end of a vertically extending pivotable shaft, each shaft having at the upper end a lever secured thereto for rotation with the shaft, and means slidably mounted on each lever for connection to the endless cable.

7. A fishing boat according to claim 5 wherein said pod extends below said bottom running surfaces of said boat hull a distance greater than said electrically powered fishing motors.

* * * * *